US005653664A

United States Patent [19]

Jennings

[11] Patent Number: 5,653,664

[45] Date of Patent: Aug. 5, 1997

[54] VARIABLE WEIGHT EXERCISE STICK

[76] Inventor: David C. Jennings, 396 Dumbarton Bl., Richmond Hts., Ohio 44143

[21] Appl. No.: 574,930

[22] Filed: Dec. 19, 1995

[51] Int. Cl.[6] ..... A63B 21/06

[52] U.S. Cl. ..... 482/93; 482/121; 473/256

[58] Field of Search ..... 482/93, 106–109, 482/50, 121, 148; 473/256

[56] References Cited

U.S. PATENT DOCUMENTS 3,758,109 9/1973 Bender ..... 482/93

4,664,373 5/1987 Hait ..... 482/109 X

*Primary Examiner*—Richard J. Apley

*Assistant Examiner*—John Mulcahy

*Attorney, Agent, or Firm*—Vytas R. Matas

[57] ABSTRACT

A portable variable weight exercise stick is formed from two easily detachable hollow sections which have access caps for adding a desired variable weight to the hollow sections and retainers therein to allow the addition of a variable weight without having it rattle in the stick during exercise. A ball of squeezable material is mounted on each end of the stick. The stick is specially formed to be ideally suited as a golf swing exercise device for building a stronger and more grooved golf swing.

15 Claims, 3 Drawing Sheets

VARIABLE WEIGHT EXERCISE STICK

BACKGROUND OF THE INVENTION

1. Field of the Invention

The present invention is generally drawn to portable exercise equipment and more particularly to portable exercise equipment adapted for quick disassembly and assembly allowing it to be easily carried with the individual for warm up exercise away from home or prior to playing games such as golf.

2. Description of the Prior Art

Presently athletes such as golfers who wish to engage in certain warm up exercises prior to starting play do so by taking some practice swings with their actual golf clubs and putters. These exercises are limited weightwise to the weight of the actual golf clubs.

As is known, warm-up exercises are best done with heavier than normal clubs. Baseball players take practice swings with a weighted bat or use two or more bats held together for such exercise swings.

To the best of applicant's knowledge there are no weighted exercise clubs in existence that are designed to be used for warm ups prior to playing a variety of games. For golfers, since the golf swing requires the application of a specific golf grip on the golf handle, grasping a plurality of golf clubs in such a golf grip is impractical. Hence, exercising the golf swing with plural golf clubs will not help "groove" your golf swing prior to play.

A weighted golf swing exercise device which could be held in a golf grip is not found anywhere in the prior art. Various exercise type sticks are found in the prior art but they are generally used to exercise hand and arm muscles rather than to perform golf swing centered exercises for "grooving" the golf swing.

As an example, U.S. Pat. No. 4,557,479 teaches an articulated V-Shaped exercise stick having individual hand handles at the ends thereof for rotation and pulling action to build hand and arm muscles. There is no way that this stick could be use to practice a golf swing using both hands at one end thereof since the handles are specifically formed for grasping by one hand. Nor is there any variable weight provisions to gradually build a stronger golf swing as you progress with the weight increases.

Other stick type exercise devices are shown in U.S. Pat. Nos. 4,869,919 and 5,167,596. Again, there are handles at the opposite ends for individual hand grasping making these devices unsuitable for "grooving" a two handed golf swing. Again there are no provisions for variable weight application to the stick.

In view of the forgoing it is seen that an easily portable and variably weighted golf swing exercise device was needed and nowhere provided to date by known exercise stick type devices. Nor is there found a variable weight application exercise stick of any kind.

SUMMARY OF THE INVENTION

The present invention solves the mentioned problems associated with prior art devices as well as others by providing an easily assembled multi-weight exercise stick for exercising and which is easily adaptable to function as a golf swing exercise stick for "grooving" a golf swing and building a stronger golf swing with progressive exercises using more and more weight in the stick.

The exercise stick is formed from two lengths of substantially identical tubing which lenghts are easily joined together by know means such as the use of a threaded coupling, press fitting them together, providing a detent assembly or a hinge assembly. Each end of the joined tubes has a cap located thereon with a small central stub extending therefrom which may be threaded and onto which a molded rubber ball may be fastened. The balls may be hand squeezed for building up arm strength or pushed together at the ends between the hands for an isometric arm exercise. Each tube is longitudinally separated into a plurality of compartments into which a varing number of weights may be insertably located up to a desired weight limit. The stick is ideally suited to be used as a variable weight golf swing exercise device to practice the golf swing to either build a sronger swing by exercising with gradually more and more weights in the stick or may be used as a warm up device to groove the golf swing prior to starting play.

In view of the foregoing it will be seen that one aspect of the present invention is to provide a portable, easily assembled exercise stick having hand exercise devices mounted at opposite ends thereof.

Another aspect of the present invention is to provide a variable weight exercise stick whose weight may be easily varied to fit the needs of the user.

Yet another aspect of the present invention is to provide a portable general exercise stick which may be easily converted into different types of exercise devices.

Still yet another aspect of the present invention is to provide a variable weight golf swing exercise stick whose weight may be easily varied to fit the needs of the user.

These and other aspects of the present invention will be more fully understood after a consideration of the detailed description of the preferred embodiment along with the accompanying drawings.

Figure 1:
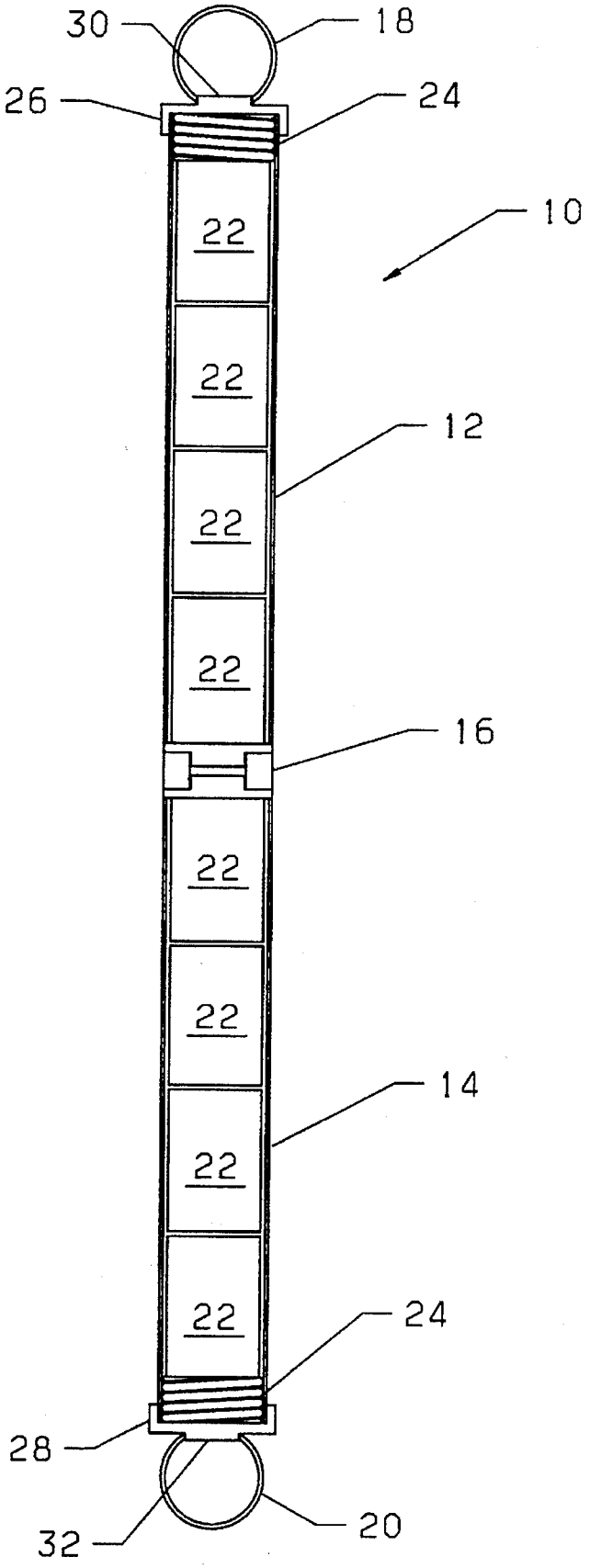
FIG. 1. is a cross-sectional side view of the assembled variable weight portable exercise stick of the present invention having exercise balls mounted at opposite ends thereof.

FIG. **4*a* is an end view of the FIG. 1** exercise stick with the cap removed showing a retainer assembly located therein to form four individual weight compartments therein.

FIG. **4*b* is an end view of the FIG. 1** exercise stick with the cap removed showing a retainer assembly located therein to form three individual weight compartments therein.

Figure 4A:
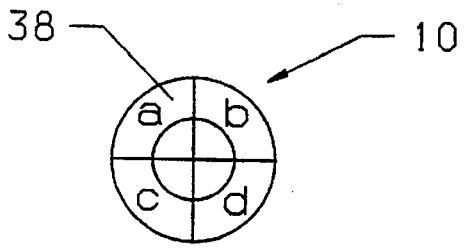

FIG. **5*a* is an isometric view of the retainer assembly used in the FIG. 4*a*** exercise stick to form the four weight compartments therein.

Figure 4B:
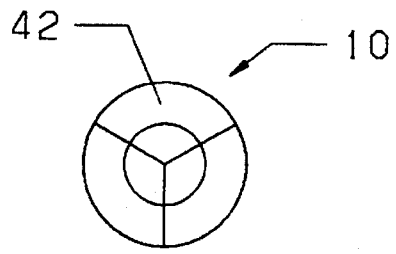

FIG. **5*b* is an isometric view of the retainer assembly used in the FIG. 4*b*** exercise stick to form the three weight compartments therein.

Figure 2:
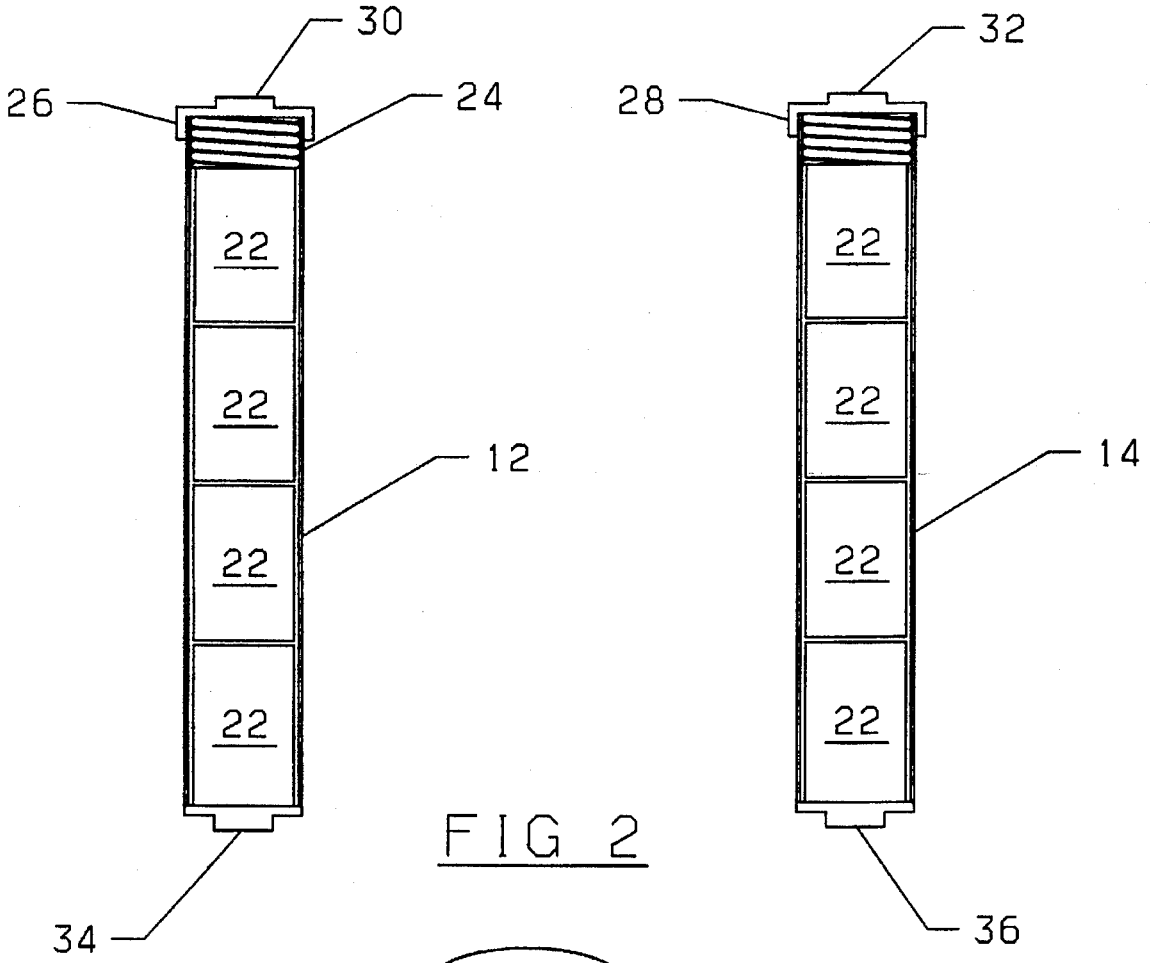
FIG. 2. is a cross-sectional side view of the FIG. 1 stick disassembled for portability or for use as individual weights for each hand to be used during running or jogging exercise.

FIG. **6*a* depicts a circular weight used in the exercise stick embodiment shown in FIG. 1 and 2**.

FIG. **6*b* depicts a cylindrical weight used in the exercise stick having inserts as shown in the FIG. 4*a* and 4*b*** embodiments.

DETAILED DESCRIPTION OF THE PREFERRED EMBODIMENT

Referring now to the drawings it will be understood that the showings therein while depicting a preferred embodiment of the invention are not intended to limit it thereto. Thus, FIG. 1 shows a weighted multi-purpose exercise stick assembly (10) which is easily disassembled making it a portable exercise accessory that could be used to stretch and condition various muscles. The exercise stick assembly 10 consists of a pair of hollow plastic tubes (12, 14) that are 3 to 4 feet in lenght and 0.75 to 1.5 inches in diameter. A threaded connector (16) is located in the center of the tubes (12,14) with the tubes being threaded therein to form a single exercise stick assembly (10) which is easily broken apart by unscrewing the tubes from the connector to make the assembly (10) easier to carry, transport, or store. Removable soft rubber balls (18,20) are mounted at the ends of the assembly (10). In addition, a number of removable weights (22) are inserted into the hollow center of the tubes (12, 14) which are pressure held from rattling therein by springs (24).

The exercise stick assembly (10) fulfills the need for a product that is not only a variable weight golf swing exercise device that will allow a golfer to srenghten his swing and allow him to groove his swing prior to playing a game of golf but is one that would enable an athlete or fitness enthusiast to build up, loosen and tone his muscles by using the assembly for numerous various exercises.

The device is versatile, convenient, ease to use, and compact. The exercise stick assembly (10) is designed to also provide a product that an athlete or fitness enthusiast could use to help stretch out before or after any vigorous physical activity and could also use to perform light weight lifting. For one of the more common stretches that could be performed, the user would lay the assembly (10) across his shoulders. While standing with his feet shoulder width apart and facing forward, he would hold the exercise stick assembly and rotate his upper body slowly to each side. This would help to stretch the muscles in the midsection. Other stretches could also be performed for other parts of the body. To tone his muscles, the user could place weights (22) in the exercise stick assembly and either lift or swing the bar. Performing basic weight lifting movements such as curls, presses, etc., would tone muscles. Of course, one of the main uses is to swing the weighted exercise stick assembly (10) like a golf club or tennis racquet to strengthen the specific muscles used to play golf or tennis. To this end, the grip for the added weight device (10) is adapted to allow the use of both hands at one end thereof similar to the grip on a golf club allowing the "grooving" of the golf swing with the extra weight. This allows the golfer to improve his swing by toning and strengthening the muscles he uses for a golf swing by exercising with progressively more weights added to the stick. As the golfer gets comfortable with his grooved swing, he adds more weight to the stick, and exercises to further increase his swing strength and to groove the stronger swing.

Additionally, the assembly (10) could also be used to help build strength in the hands and forearms by squeezing the balls (18, 20) on the ends of the bar. A user would simply squeeze the individual balls (18, 20) to improve his grip strength, or he could hold the bar at chest height and push the balls inward to develop his chest by these isometric exercises. If the lenght of the stick is uncomfortable the stick can be broken down and one tube may be used to place the squeezable balls at he ends thereof as shown in FIG. 2.

When not in use, the exercise stick assembly (10) could be taken apart so that it would be shorter and easier to carry. This would allow a fitness enthusiast to put it in his equipment bag and carry it to the gym or health club to loosen up before starting a regular workout. An athlete could also take the stick to a game to loosen up before starting to play. A golfer could carry it in his golf bag to loosen up before teeing off on the first hole. When taken apart, the stick would also be short enough that it could be easily carried in a briefcase or suitcase, so it would be ideal for a person who travels frequently.

This disassembly is done by unthreading the balls (18, 20) from the ends of the assembly (10). The balls (18, 20) are hollow and are located on end caps (26, 28) which have studs (30, 32) onto which the balls (18, 20) are tightly pressed. Of course, the studs (30, 32) could be threaded to provide a more secure retainer therefor.

Next, the tube (12) is unscrewed from the threaded connector (16) while holding the tube (14). The connector (16) is then unscrewed from tube (14). It will be noted that both tubes (12) and (14) have stepped ends (34,36) which prevent the weighs (22) from falling out from that end. The studs (34,36) have external thread thereon which are complimentary to the internal threads of the connector (16). When thus disassembled the assembly (10) forms two individual hand weights, as best seen in FIG. 2, for use during running or jogging.

Figure 6A:
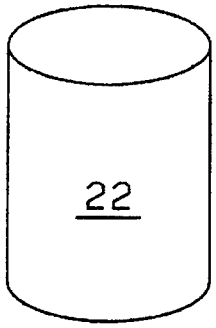

The individual weights (22) used in the FIG. 1 embodiment are shown in FIG. 6*a* as circular metal weights which are coated with plastic and are inserted into the tubes (12, 14) after the internally threaded caps (26, 38) are unscrewed from the externally threaded ends of the tubes (12, 14). The number of weights will depend upon the user but it was determined that the optimal weight for a fully weighted stick is ten pounds. Since eight total weights (22) are used, each weight is approximately 1.25 pounds. Of course these weights may be varied to suit the ability of the user. If less than the full eight weights are used, the spring (24) will keep whatever weights are inserted from rattling in the stick.

Figure 3:
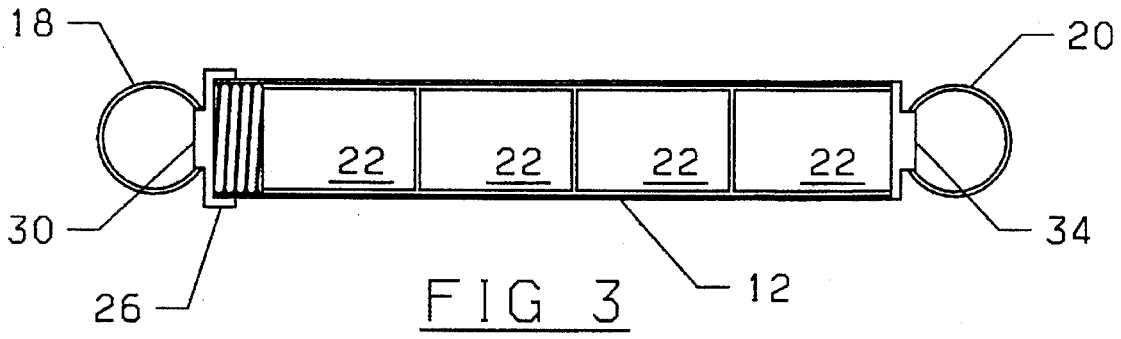
FIG. 3 is a cross-sectional side view of one of the FIG. 2 weights assembled with a squeeze ball at both ends thereof for isometric exercise with a shorter stick.

It was mentioned that in some situations isometric exercises may be performed by pressing the balls (18, 20) between the hands or by squeezing same and that sometimes a shorter stick length may be required for such exercises. It will be noted that the stepped ends (34, 36) of the stick are threaded and are the same size as the studs (30, 32). This allows the balls (18, 20) to be placed on either of the disassembled individual tubes (12, 14) shown in FIG. 2 to provide a shorter stick exerciser. FIG. 3. shows the balls (18, 20) placed on the stick (12) but the same procedure would apply to stick (14).

The use of the weights (22) in the assembly (10) requires the spring (24) to prevent the weights (22) from rattling in the assembly (10). When fewer weights (22) are used vigorous exercise still may cause some rattling of the weights in the stick. An alternate weighting system is shown in the FIG. 4–6 embodiments which solves this problem.

Figure 6B:
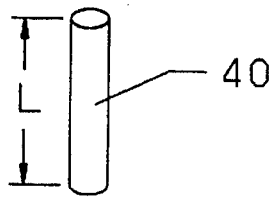
Figure 5A:
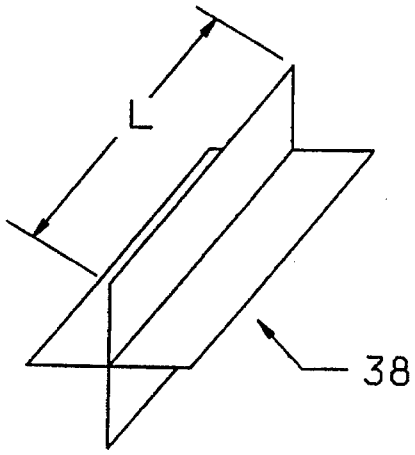

A rectangular divider assembly (38) is shown in FIG. 5*a* which has a length L substantially equal to the length of the tubes (12, 14) and fits snugly into each as seen in FIG. 4*a* to form four compartments (a–d) in each tube (12, 14). A cylindrical weight (40) as seen in FIG. 6*b* can then be snuggly inserted into each compartment (a–d). The weights (40) being the same lenght as the individual tubes (12,14) keeps them from moving up and down in the stick. The diameters of the weights (40) are made to snuggly fit into each of the compartments a–d to prevent side motion therein. This arrangement prevents the weights from rattling in the stick no matter how violent is the exercise being performed and no matter how many weights are used in the stick.

Since, as was mentioned earlier, a fully weighted stick assembly (10) is intended to have ten pounds of added weight, the individual weights are made to be 1.25 pounds. Thus weight may be added to the assembly in 1.25 pound increments without any rattling even under extreme exercise conditions.

Figure 5B:
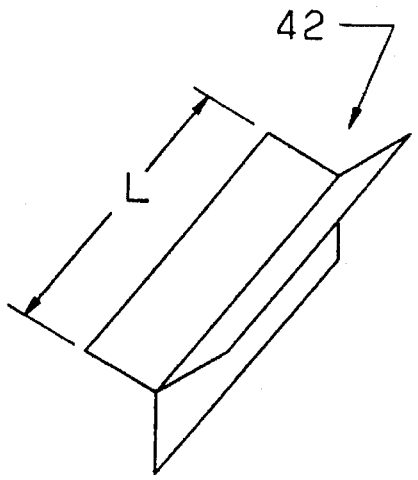

FIG. 5*b* shows another embodiment having a triangular shaped divider assembly (42) which is similarly used as the assembly (38). However, since there are now only 6 compartments, the cylindrical weights (40) are made 1.66 pounds each and provide weight increases of the assembly (10) of 1.66 pounds.

The exercise stick assembly assembly (10) is produced using conventional and readily available materials and manufacturing processes. No new production technology is thus required.

The assembly (10) could be produced from two lengths of extruded polyvinylchloride (PVC) plastic pipe that would be threaded at the ends and joined together in the middle by a hardware store available threaded coupling. The ends caps are also available and a small, threaded stud could be attached to each end cap in a known manner. The balls for the ends of the bar are hollow and could be molded from rubber. If needed, the balls could be fitted with an internally threaded plastic cap (not shown) that would screw onto the studs on the end caps. The weights for the bar could be cast or extruded from steel, lead or other known materials. Metals of various densitities could be used to have weights of the same size but varying in weight. This would allow each different weight to fit snuggly in the stick and not move around while the bar is in use.

From the foregoing it is seen that the assembly (10) can be used to perform a large variety of exercises. The following is an example of some of these exercises:

1. Arm Curl.

2. Torso twist-standing upright with club across shoulders. Twist upper body right to left and opposite way with feet planted firm.

3. Back Stretch from standing position place stick at arms length in front or you with end on ground, bend from waist until back is parallel to ground.

4. Swing-Grip stick as a golf club, swing stick as you would a golf club.

5. Tilt-Grip stick with both hands and extend arms above head, tilt to the sides back and forth.

6. One Arm Swing-grip stick with one hand only and perform golf swing. Repeat with other hand.

7. Press-Grasp stick with both hands, place shoulder high, press stick over head and bring down.

8. Wrist Curls—In a seated position grasp stick with both hands with arms resting on legs, curl wrists up and down, can be performed with hands facing up and facing down 9. Waist Twist-Hold stick in front or you check high, twist to right then to left.

10. Over the Head-While laying on floor extend arms over head grasp stick and raise over head and back to floor.

11. Separate stick and use for walking weights.

12. Lateral Raise-Grasp separated stick in each hand standing upright with hand's at sides, raise arms to shoulder height then back to sides.

13. Deep Knee Bends—place stick across shoulders and bend knees to parallel.

14. Baseball Swing.

15. Tennis Swing.

16. Finger Curls with stick separated or together.

17. Squeeze Balls for arm strength.

18. Push on each end of stick with balls.

Certain modifications and additions have been deleted herein for the sake of conciseness and readability but are intended to fall with the scope of the following claims. As an example, a golf grip handle could be used instead of one of the balls to make the assembly a more true to life golf swinging exercise stick. Also, it will be clear that this exercise stick is especially usefull for therapy since it provides the wide range of therapeutic exercises needed. Also, end caps (26,28) instead of being threaded could be made movable against the spring (24) to allow the compression thereof by pressing the ends together as an exercise. Of course some stop would have to be provided for the caps to prevent them from being pushed out by the spring. A pin would provide this function.

What is claimed is:

1. A variable weight portable exercise assembly comprising:

a first hollow section having a base and an end with a ball of squeezable material mounted thereon;

a second hollow section having a base and an end with a ball of squeezable material ball mounted thereon;

connecting means for retaining said first and second sections rigidly connected together in a straight line to form a single straight line unit;

removable weights located in said first and second hollow sections; and retaining means located in the hollow part of each of said first and second section for preventing the removable weights located therein from rattling inside the assembly during exercise.

2. A variable weight portable exercise assembly as set forth in claim 1 wherein said retaining means includes a divider assembly located in the hollow of said first and second section to define a series of areas therein for snugly retaining a weight therein.

3. A variable weight portable exercise assembly as set forth in claim 2 wherein said divider assembly divides said first and second hollow section into four sections.

4. A variable weight portable exercise assembly as set forth in claim 2 wherein said divider assembly divides said first and second hollow section into three sections.

5. A variable weight portable exercise assembly as set forth in claim 2 wherein the weights are formed to have a length substantially equal to the length of said first and second section to fit snugly in said longitudinal area.

6. A variable weight portable exercise assembly as set forth in claim 5 wherein the weights are cylindrical.

7. A variable weight portable exercise assembly as set forth in claim 1 wherein the end of said first section has a cap with a stud thereon for mounting said ball.

8. A variable weight portable exercise assembly as set forth in claim 7 wherein said stud has external threads for mounting said ball.

9. A variable weight golf swing exercise stick formed from a pair of hand exercise sticks, comprising:

first and second cylindrical hand weight sticks having a hollow section therein;

means for sealing one end of each of said first and second cylindrical sticks;

a removable cap at the other end of each stick for allowing the addition of weight into the hollow section of each of said sticks to snugly hold the added weights therein without rattling;

means for connecting said first and second hand weight sticks together in a straight line to form an elongated one piece golf swing exercise stick;

retaining means located in the hollow section of each of said first and second sticks for preventing the added weights therein from rattling inside said exercise stick during exercise; and wherein said first and second cylindrical sticks have a ball of squeezable material located on the ends thereof.

10. A variable weight golf swing exercise stick as set forth in claim 9 wherein said retaining means includes a divider assembly located in the hollow of said first and second section to define a series of longitudinal areas therein for snugly retaining a weight therein.

11. A variable weight golf swing exercise stick as set forth in claim 10 wherein said divider assembly divides said first and second hollow sections into four sections.

12. A variable weight golf swing exercise stick as set forth in claim 10 wherein said divider assembly divides said first and second hollow sections into three sections.

13. A variable weight golf swing exercise stick as set forth in claim 9 wherein the weights are formed to have a length substantially equal to the length of said first section allowing them to fit snuggly therein.

14. A variable weight golf swing exercise stick as set forth in claim 21 wherein said first and second cylindrical sticks are formed from cylindrical sections.

15. A variable weight golf swing exercise stick as set forth in claim 14 wherein said connecting means comprises a threaded connector for joining said first and second sticks in line to form said elongated golf swing exercise stick.

* * * * *